US006519801B1

(12) United States Patent
Chao

(10) Patent No.: US 6,519,801 B1
(45) Date of Patent: Feb. 18, 2003

(54) PAINT SCRAPER

(76) Inventor: Chien-Chuan Chao, No. 13, Lane 15, Sec. 2, Fuhsing Rd., S. Dist., Taichung (TW)

( * ) Notice: Subject to any disclaimer, the term of this patent is extended or adjusted under 35 U.S.C. 154(b) by 196 days.

(21) Appl. No.: 09/710,070

(22) Filed: Nov. 10, 2000

(51) Int. Cl.[7] ..... A47L 13/02
(52) U.S. Cl. ..... 15/236.01; 30/169
(58) Field of Search ..... 15/236.01, 236.08, 15/245.1; 30/169

(56) References Cited

U.S. PATENT DOCUMENTS 2,257,314 A * 9/1941 Shinn, Jr.
5,924,204 A * 7/1999 Lane
6,000,137 A * 12/1999 Gamba

FOREIGN PATENT DOCUMENTS

GB 0013526 * 2/1914

* cited by examiner

*Primary Examiner*—Randall E. Chin
(74) *Attorney, Agent, or Firm*—Hedman & Costigan, P.C.

(57) ABSTRACT

A paint scraper has a lower cover, an upper cover detachably engaged with the lower cover, a locking device securely clamping the lower cover to the upper cover and a blade clamped between the lower cover and the upper cover. The locking device has a lever with a protruding edge detachably pressing against a face of the upper cover to provide even pressure to the upper cover to ensure the engagement between the lower and the upper covers. The lever is pivotally pressed against the upper cover that is movable relative to the lower cover, so that the pivotal movement of the lever is able to secure the engagement between the lower and the upper covers and the upper cover is able to move forward with respect to the lower cover to conceal the blade.

7 Claims, 4 Drawing Sheets

PAINT SCRAPER

BACKGROUND OF THE INVENTION

1. Field of the Invention

The present invention relates to a paint scraper, and more particularly to a paint scraper having a base and a cover movable with respect to the base so that a blade sandwiched between the base and the cover is able to be concealed under the cover for storage when the cover is moved to the edge of the blade.

2. Description of Related Art

A conventional paint scraper generally has an upper cover, a lower cover, a blade securely sandwiched between the upper cover and the lower cover and a bolt extending from the lower cover to the upper cover to secure the engagement between the lower and the upper covers to securely hold the blade. Because the lower cover and the upper cover are engaged with each other by the bolt that is inserted through the center of the lower cover and the upper cover, only the center of the blade is pressed by the covers. When this paint scraper is used, the bumps on the wall often causes the blade to tilt due to the manner the blade is secured between the lower cover and the upper cover, which causes inconvenience to the user. Furthermore, when the paint scraper is not in use, the protruding blade may cuts people who accidentally touch the blade. This proves particularly dangerous to people getting tools from a toolbox where the scraper is stored.

To overcome the shortcomings, the present invention tends to provide an improved paint scraper to mitigate and obviate the aforementioned problems.

An objective of the invention is to provide an improved paint scraper having a wedged lower cover and a wedged upper cover able to secure the wedged lower cover and being movable with respect to the wedged lower cover, so that the blade clamped between the wedged lower and upper covers is able to be concealed under the upper cover to avoid possible injury to people.

SUMMARY OF THE INVENTION

The main objective of the invention is to provide an improved paint scraper that has a wedged lower cover and upper cover between which the blade is secured. With the wedged shape of the lower cover and the upper cover, the pressure applied on the blade is evenly distributed and tilting of the blade is avoided.

Another objective of the invention is to provide an improved paint scraper. The upper cover is movable with respect to the lower cover, such that when the paint scraper is not in use, the blade is able to be concealed under the upper cover to avoid any kind of injury to people.

Other objects, advantages and novel features of the invention will become more apparent from the following detailed description when taken in conjunction with the accompanying drawings.

DETAILED DESCRIPTION OF PREFERRED EMBODIMENT

Figure 1:
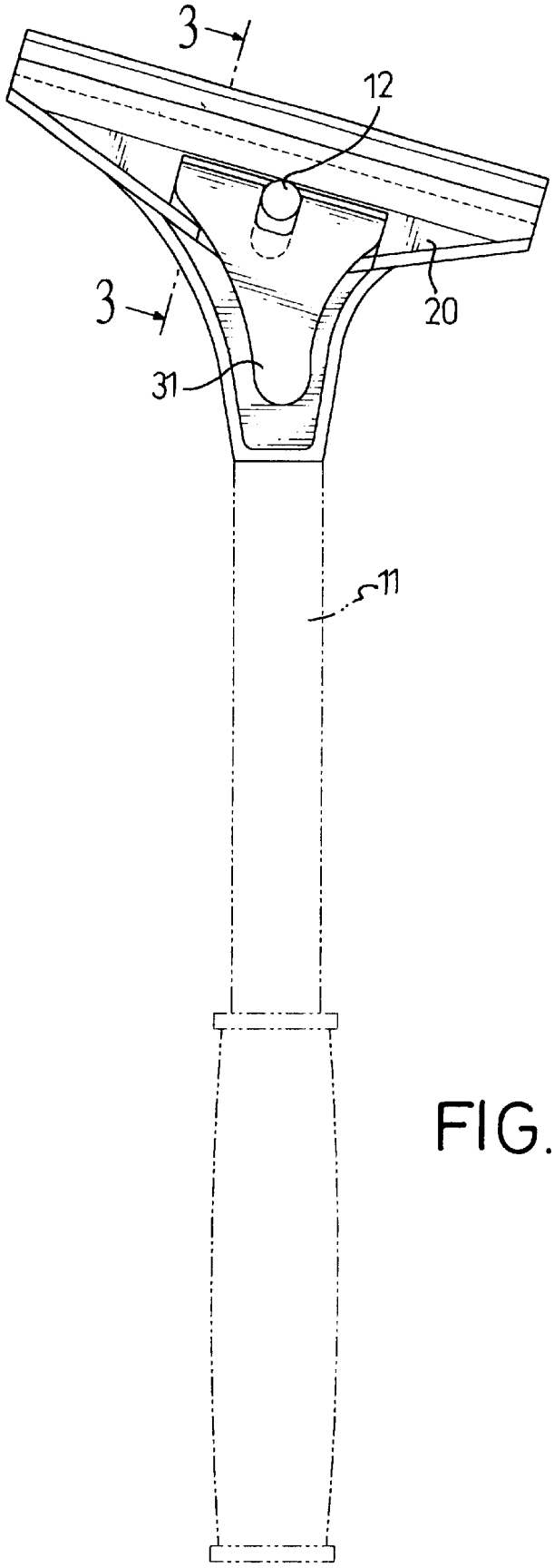
FIG. 1 is a top plan view of the paint scraper in accordance with the present invention.
Figure 2:
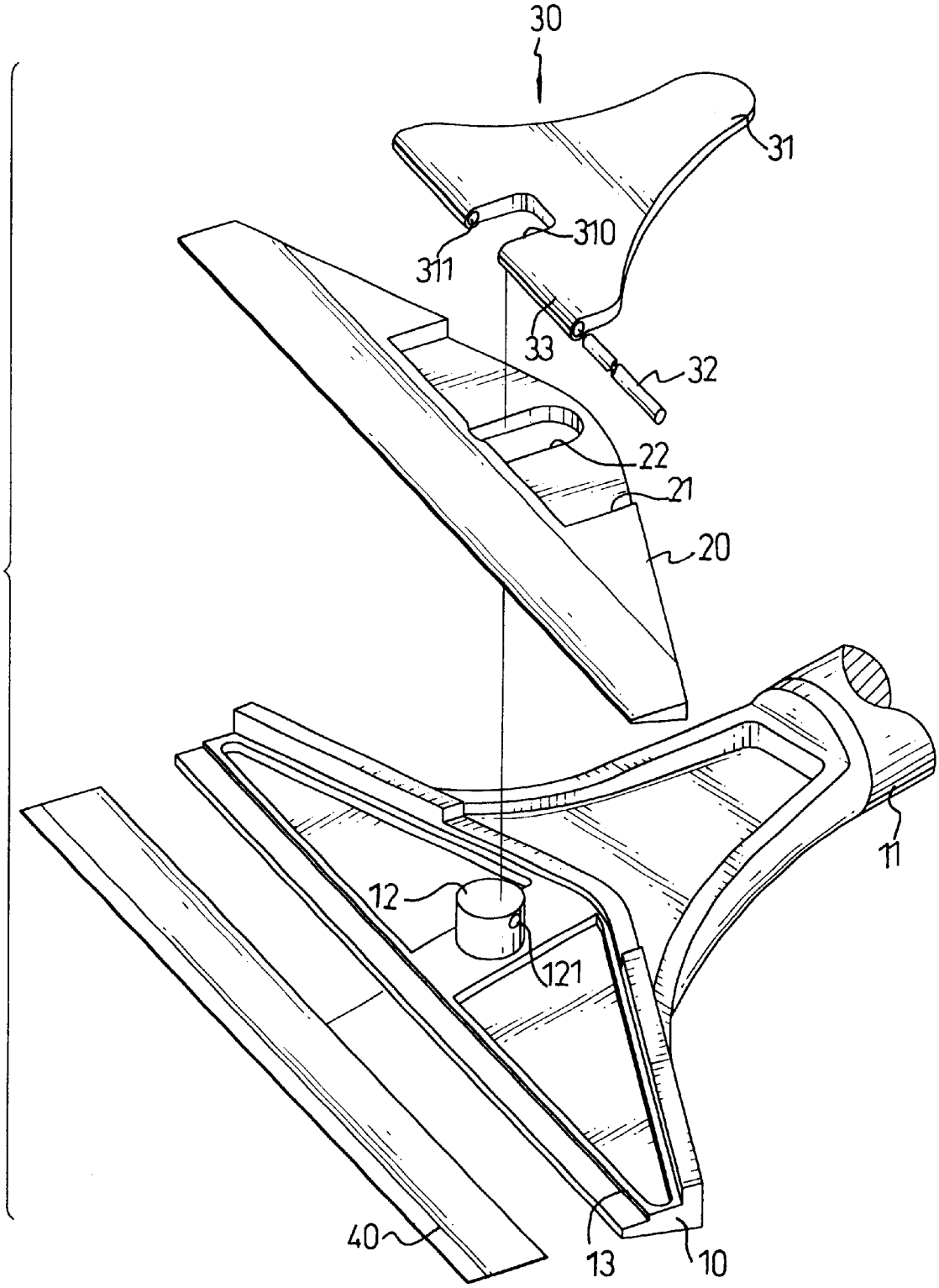
FIG. 2 is an exploded perspective view of the paint scraper in FIG. 1.
Figure 3:
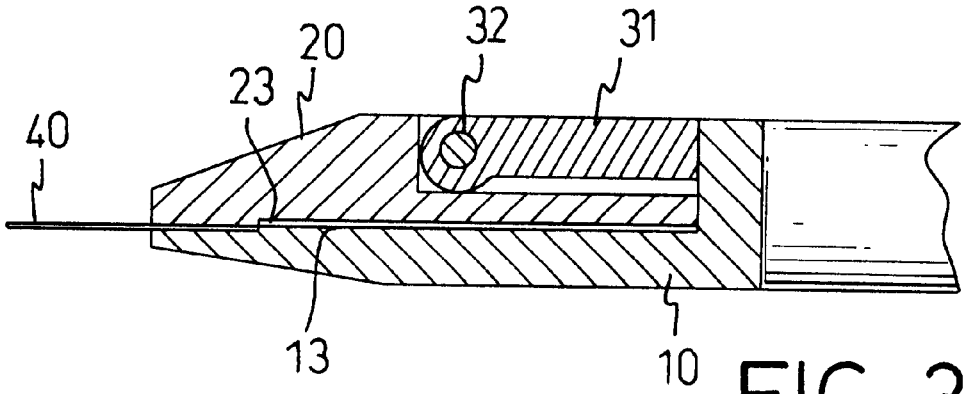
FIG. 3 is a cross sectional side plan view of the paint scraper along line 3—3 in FIG. 1.

With reference to FIG. 1, 2 and 3, a paint scraper in accordance with the present invention has a wedged lower cover (10) with a handle (11) integrally extending out from the lower cover (10), a wedged upper cover (20), a quick release clamp (30) and a blade (40).

The wedged lower cover (10) has positioning pin (12) pivotally mounted on the lower cover (10) with a pivot pin hole (121) defined through the positioning pin (12) and a first step (13) formed on the leading edge of the lower cover (10).

The wedged upper cover (20) has a recess (21), and elongated opening (22) and a second step (23). The elongated opening (22) is defined in a bottom defining the recess (21) to correspond to the positioning pin (12) on the lower cover (10). The second step (23) is formed on a bottom face of the upper cover (20) to complementarily correspond to the first step (13).

The quick release clamp (30) has a substantially triangular lever (31), a cutout (310), a slit (311) and a protruding edge (33). The cutout (310) is defined in the leading edge of the lever (31) to correspond to the positioning pin (12) of the lower cover (10). The slit (311) is defined through the face of the edge to allow a pivot pin (32) to extend through the slit (311). The protruding edge (33) is formed on the leading edge of the lever (31).

The blade (40) is thus clamped between the wedged upper cover (20) and the wedged lower cover (10).

To assemble the paint scraper, the elongated opening (22) in the wedged upper cover (20) is placed over the positioning pin (12) so the pivot pin hole (121 ) is exposed on top of the upper cover (20). Because the cutout (310) is wider than the diameter of the positioning pin (12) and because the recess (21) is slightly larger than the lever (31), the positioning pin (12) is able to be accommodated in the cutout (310) to allow the pivot pin (32) to extend through the slit (311) and the pivot pin hole (121), and the lever (31) is able to lie flush with the upper cover (20) after the lever (31) is received in the recess (21). After the pivot tin (32) extends through the slit (311) and the pivot pin hole (121), the pin (32) stays in the slit (311) and the pivot pin hole (121) so that the upper cover (20) and the lower cover (10) are securely connected together. When the assembly of the upper cover (20) and the lower cover (10) is finished, the blade (40) is placed between the wedged upper cover (20) and the wedged lower cover (10) and is clamped between the first and the second steps (13, 23).

Figure 4:
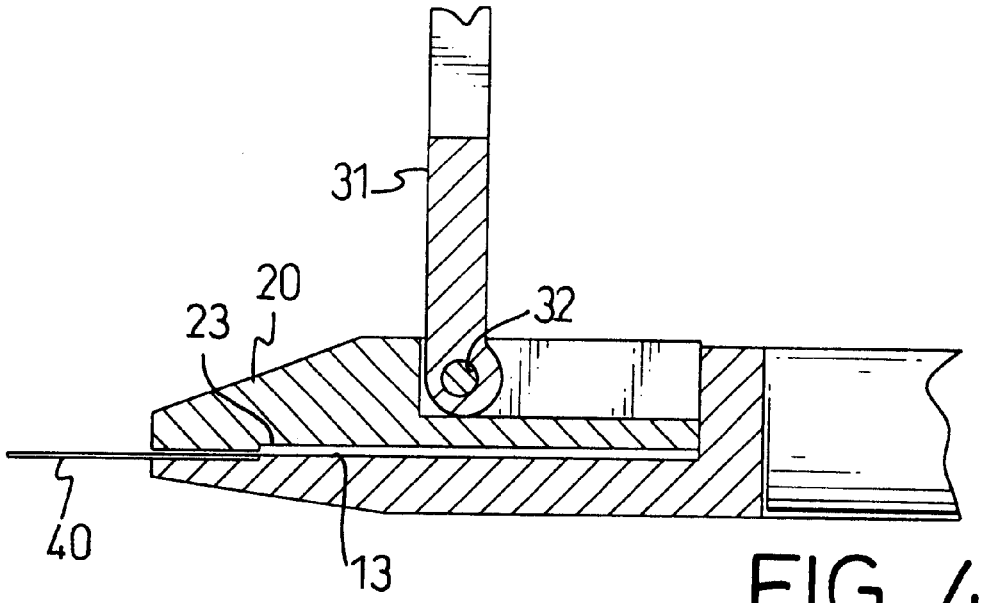
FIG. 4 is an operational cross sectional side plan view of the paint scraper along line 3—3 in FIG. 1 clamping action between the lower cover and the upper cover released.

Because the protruding edge (33) presses against the bottom defining the recess (21) and the first and the second steps (13,23) are mutually complementarily formed, the pressure applied to the blade (40) is evenly distributed and there is no worry about the blade (40) tilting. With reference to FIG. 4, when the lever (31) is lifted, the disengagement of the protruding edge (33) of the quick release clamp (30)

will release the pressure applied to the blade (40), such that the blade (40) is able to be replaced.

Figure 5:
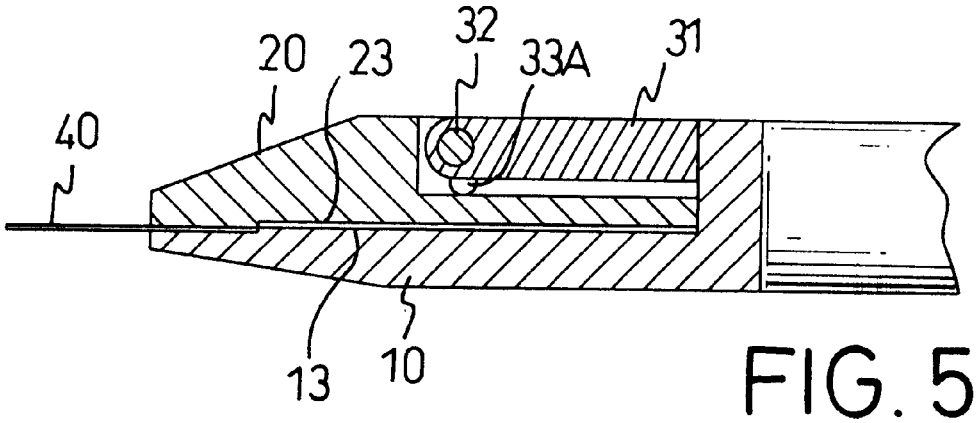
FIG. 5 is a cross sectional side plan view of another preferred embodiment of the paint scraper along line 3—3 in FIG. 1.

With reference to FIG. 5, a protrusion (33A) is formed on the inside edge of the lever (31) near the slit (311). Because of the protrusion (33A), the lever (31) is able to selectively secure the engagement between the upper cover (20) and the lower cover (10) by the pivotal movement of the lever (31).

Figure 6:
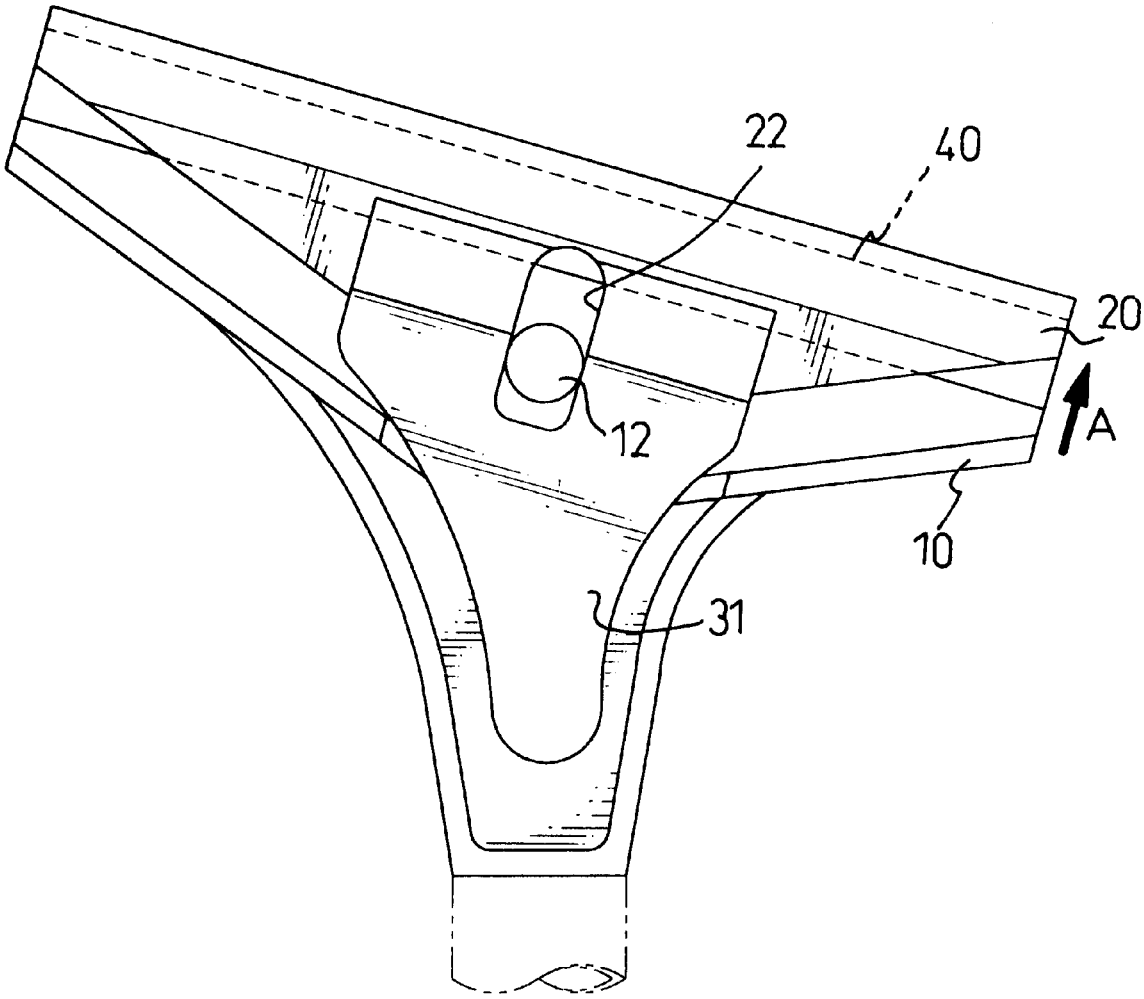
FIG. 6 is an operational top plan view of the paint scraper in FIG. 1 showing the movement of the upper cover with respect to the lower cover to cover the blade.

With reference to FIG. 6, to secure the paint scraper after use, the user first lifts the lever (31) to release the pressure between the upper cover (20) and the lower cover (10). Then the user moves the upper cover (20) with respect to the lower cover (10) along the elongated opening (22) of the upper cover (20). With the forward movement of the front cover (20) with respect to the lower cover (10), the blade (40) is able to be concealed under the front cover (20) so that injury by the sharp edge of the blade (40) is prevented.

The present invention has She following advantages:

1. even pressure is applied to the blade by the protruding edge to hold the blade in one position during operation;
2. possible injury by the blade is avoided by the forward movement of the front cover relative to the lower cover.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A paint scraper comprising a lower cover, an upper cover detachably engaged with the lover cover, a locking device securely engaging the lower cover to the upper cover and a blade sandwiched between the lower cover and the upper cover, wherein the improvement comprises:

the lower cover having a positioning pin pivotally mounted on the lower cover, and the upper cover having an elongated opening defined to correspond to the positioning pin to allow the positioning pin to extend through the elongated opening, wherein the locking device has a lever pivotally engaged with the positioning pin and a pin connecting the lever to the positioning pin.

2. The paint scraper as claimed in 1, wherein a cutout is defined in the lever to accommodate the positioning pin and the upper cover has a recess defined to receive the lever and wherein the elongated hole is defined in a bottom defining the recess.

3. The paint scraper as claimed in claim 2, wherein the lever has a slit and a pivot pin hole is defined through the positioning pin to align with the slit in the lever to allow a pivot pin to extend into the aligned slit and pivot pin hole to pivotally attach the lever to the positioning pin.

4. The paint scraper as claimed in claim 2, wherein the lever has a protruding edge selectively press against the bottom defining the recess of the upper cover.

5. The paint scraper as claimed in claim 2, wherein the lever has at least two protrusions formed on opposite ends of an edge of the lever to selectively press against the bottom defining the recess of the upper cover.

6. The paint scraper as claimed in claim 2, wherein the lower cover has a first step and the upper cover has a second step complementarily and oppositely formed with respect to the first step so as to securely clamp the blade between the lower and the upper cover.

7. The paint scraper as claimed in claim 1, wherein the lower cover has a first step and the upper cover has a second step complementarily and oppositely formed with respect to the first step so as to securely clamp the blade between the lower and the upper cover.

* * * * *